US005826533A

United States Patent [19]

Stangroom et al.

[11] Patent Number: 5,826,533

[45] Date of Patent: Oct. 27, 1998

[54] TWIN-HULLED BOAT

[75] Inventors: James Edward Stangroom, S. Yorks; John George Clancy, Sheffield, both of England

[73] Assignee: Silky Limited, S. Yorks, United Kingdom

[21] Appl. No.: 765,507

[22] PCT Filed: Jun. 28, 1995

[86] PCT No.: PCT/GB95/01515

§ 371 Date: Dec. 20, 1996

§ 102(e) Date: Dec. 20, 1996

[87] PCT Pub. No.: WO96/00680

PCT Pub. Date: Jan. 11, 1996

[30] Foreign Application Priority Data

Jun. 29, 1994 [GB] United Kingdom ..... 9413017

[51] Int. Cl.[6] ..... B63B 7/04

[52] U.S. Cl. ..... 114/352; 114/61

[58] Field of Search ..... 114/61, 63, 56, 114/363, 343, 364, 344; D12/317, 318, 304

[56] References Cited

U.S. PATENT DOCUMENTS

| | | | |
|---|---|---|---|
| Re. 24,618 | 3/1959 | Rosenberg et al. | 441/127 |
| 2,975,747 | 3/1961 | Opie | 114/61 |
| 3,045,263 | 7/1962 | Blachly | 114/352 |
| 3,114,157 | 12/1963 | Stockmann | 114/61 |
| 3,203,014 | 8/1965 | Krueger | 114/344 |
| 3,426,716 | 2/1969 | Hackworth | 114/61 |
| 4,295,236 | 10/1981 | Upchurch | 114/61 |
| 4,303,033 | 12/1981 | King | 114/61 |

FOREIGN PATENT DOCUMENTS

| | | | |
|---|---|---|---|
| 792317 | 3/1958 | United Kingdom . | |
| WO 89/05260 | 6/1989 | WIPO | 114/61 |

*Primary Examiner*—Ed L. Swinehart

*Attorney, Agent, or Firm*—Trexler, Bushnell, Giangiorgi & Blackstone, Ltd.

[57] ABSTRACT

A twin-hulled boat (1) is constructed from three individual parts being two parallel, relatively narrow and relatively long hulls (2) each individually connected, at releasable joints (13,9), to a central, rigid bridge section (3), and separable, upon release of the joints (13,9) into three individual parts. Each hull (2) has a bow section (4) and a stern section (5). The hulls (2) have virtually flat bottoms (6) apart from the bow sections (4). The releasable joints are two-part metal-to-metal friction joints with one-part (13) of each of said joints located within, and at a lateral side of, said central bridge section (3), and the other part (9) of each of said joints located at inner gunwales (21) of each hull (2), with, for each of said joints, individual independent, screw-incorporating means (26),(24),(27),(29), (33) operable on both parts (13,9) of each joint to urge the parts (13,9) of each said joint together into tight frictional engagement with one another.

25 Claims, 8 Drawing Sheets

TWIN-HULLED BOAT

This invention relates to a twin-hulled boat designed to be propelled by an outboard motor intended primarily as a work-boat for diving, fishing, fish-farming etc., and of the "Flat-Top" type used in the Florida Everglades for example, with the decks of the two hulls and the top of the central bridge-section arranged to be flush, giving a large area of clear deck, whilst normal catamarans, designed for sailing, have deep "V" hulls to give a good grip on the water. In contrast, Rogers (EP 0 353 901) describes a demountable sailing catamaran comprising two flat-bottomed planing hulls joined by a metal support frame with fabric stretched across it. This resembles the system used in most small sailing catamarans, in which there are two horizontal struts between the hulls at bow and stern, with fabric stretched between them, but in Rogers' design, the ends of the struts are bent downwards and fasten in vertical hull sockets.

In Rogers' design and others (e.g. Bachley, U.S. Pat. No. 3,303,520), the gap between the hulls is considerably wider than the hulls themselves. This is advantageous in a sailing catamaran, since it makes the vessel very resistant to heeling, so that the mast remains vertical and the sails function more efficiently; and also in a motorised catamaran, as increasing the space between the hulls increases the deck area. On the other hand, this wide spacing greatly increases the strain upon the hull fixings. In the Rogers design, the metal frame, being with fabric, can flex to relieve the stress. In Bachley's design, the integrity of the vessel is secured by using rigid boards across the vessel which act as cross-members as well as forming the front and back coamings of the cockpit. Both of these methods have limitations. Rogers' method does not allow the possibility of a rigid deck, while Bachley's design limits the free deck areas and requires heavy and cumbersome components. Neither of these methods is suitable for larger craft.

According to the present invention, there is provided a twin-hulled boat comprising two parallel, relatively narrow and relatively long hulls and a central, rigid bridge section, with each hull having a bow section and a stern section, and with bottoms of the hulls flat and parallel to the bridge section both transversely and longitudinally, apart from the bow sections, characterised in that the beam ratio of hull/bridge section/hull is 30%/40%/30% approximately.

The long water-lines, relatively narrow hulls and a central bridge section that is in effect only slightly wider than the hulls themselves give the boat in accordance with the invention low resistance and a high maximum speed when functioning on displacement, while the large flat areas give a low planing speed. As a result, such a boat requires about half the engine power of a conventional boat for equivalent performance. Furthermore, the long, narrow planing areas allow water to escape to the sides, reducing slamming in a sea; they also allow such a boat to avoid the inefficient bows-up attitude adopted by many conventional planing hulls. Finally, the long hulls give good directional stability and consequently such a boat is very easy to steer.

Further and preferred features of the invention are as follows. The hulls are flat topped, and the bridge section is flush with the hull tops, to form a single flat deck area. The flat bottom extends from the base of the stern section forwards for approximately 58% of the overall length of the boat. After approximately 58% of the overall length of the boat, the bottom is formed into a "V" of approximately 143° for approximately 23% of the overall length of the boat to meet the bow section. The boat is readily separable into three parts, being the two hulls and the central rigid bridge section with engine attached, for land transport. Separation is total, with the three parts being three individual elements. Alternatively, separation may be relative, with the two hulls remaining hinged to the bridge section and being hingeable to a land transportation position. The hulls are made of fibre-glass (GRP) and filled with plastic foam.

In practice, in order for the attachment of the hulls to the central bridge section to function properly, the hulls themselves must be slightly flexible (vide infra). Preferably, to achieve the desired properties of lightness, flexibility and strength, the hulls should be laid up using woven glass cloth rather than the more conventional chopped strand—the latter gives a strong but brittle hull. Woven glass cloth must, conventionally, be laid up by hand, and so is normally avoided in conventional boat-building. However, as the mould for the long, narrow hulls of the boat of the invention resembles a trough, in accordance with a preferred feature the trough is arranged to be rotated about its long axis, so that the operator can always work down-hand. This means that the hand lay-up can be much faster and more efficient than normal.

Furthermore, decked GRP hulls are conventionally made in two sections which are subsequently bonded together. The top edge of the lower hull moulding is rolled outward to give a narrow flange to which the deck is attached. This flange, which is often protected by a rubber rubbing strip, must be narrow and represents a line of weakness. The "rolling mould" approach to the manufacture described above allows the top edge of the hull moulding to be rolled inward:—the mould for the hull section is made with a removable top. This allows the flange for attaching the deck section to be made much wider than normal, so the attachment is much more secure. It also allows the gunwales to be reinforced to accommodate attachments for the central bridge section and also stanchion sockets for a grab line. Each hull becomes, in effect, a closed tube, and is therefore very strong in relation to its weight.

Conventional demountable catamarans are assembled by fitting long cross-members in sockets in each hull. Since the sockets themselves cannot be made or aligned very accurately using conventional boat-building techniques, the cross-members must be allowed a certain amount of clearance, and this leads to movements in the socket, fretting, etc. Furthermore, the cross-members themselves must be slightly flexible, to take up inevitable misalignments, so they cannot be incorporated into a rigid deck structure. Normally, in small sailing catamarans, a sheet of canvas is stretched between the two cross members to, forming the "trampoline". This system is obviously unsuitable for larger boats carrying heavier loads, and the need to have cross-members long enough to extend right across the boat is inconvenient at best.

Preferably, the central bridge-section is made up on a metallic frame and is therefore rigid.

The frame is preferably constructed from hollow section tubing of circular or rectangular (and preferably square) profile. The metallic material may be steel coated, even if only by paint, to resist seawater attack, or may be a light-weight alloy.

In detail the frame may comprise four longitudinal beams, located in spaced-apart, parallel relationship, and four transverse beams secured, e.g. by welding, bolts or fittings, to the undersides of the four longitudinal beams. The underside of the frame is also preferably provided with rearwardly extending support beams for a transom to which an outboard motor is attachable.

Preferably, four heavy steel plates are fixed, at roughly equal intervals down each side of the bridge-section, and four corresponding plates are fixed to the inner gunwale of each hull, so as to provide four attachment points at each side of the central bridge section. To assemble such a boat, the corresponding plates of a hull and the bridge section are brought together, and each pair clamped together preferably by a screw mechanism preferably operated from the outside of the hull. The screw mechanisms hold the plates together with a force of several tons, so friction prevents the hulls moving with respect to the bridge-section. On the other hand, since the attachment points are basically a pair of flat plates, they will tolerate very significant misalignments. Using conventional fabrication techniques, it is virtually impossible to guarantee that all the plates on each hull, or on each side of the bridge-section will be co-planar, so that if the hulls were rigid, all the load would be taken by one or two attachment points. However, hulls made in accordance with this aspect above can flex without damage to take up minor misalignment, so allowing the load to be shared between all the attachment points. However, the material is stiff in its own plane, and so a very rigid attachment results.

In practice, the screw mechanisms are made so that they can be easily assembled with very considerable misalignment; operating the screw mechanism then draws the hull into the correct position with respect to the bridge-section. Each screw mechanism is preferably housed in a steel tube which extends across the hull and terminates in a heavy boss at each end. This tube with its bosses is preferably laid up into the glass fibre when the hull is built and thereby spreads the load throughout a wide area of the hull. The screw mechanisms can be withdrawn from the tubes for greasing, etc. when required.

It will be seen that this system allows the central bridge section to be a rigid structure carrying a solid deck. It avoids the inconvenience of long cross-members extending across the whole of the boat, and can be easily extended to larger sizes of boat.

It is clearly advantageous if the boat in accordance with the invention can be launched off virtually any beach. If it is necessary to cross very rough or soft ground, the hulls can be completely detached from the bridge-section and carried by hand—they would be a light burden for four people. In this case, the bridge-section would be used as an engine-barrow using the "FS Wheels" (vide infra). The boat would then be assembled at the water's edge by offering each hull in turn up to the bridge-section and securing it as already described. This is inevitably a relatively slow operation.

If the boat is to be launched in more favourable circumstances, for example off a concrete slip, the hinged hull proposal additionally serves to maintain the hulls in correct position for attachment to the central bridge section preferably by providing loose-fitting hinges at the junctions between each hull and the bridge-section. The Bachley patent refers to the use of hinges between the hulls and the bridge section of his boat, but in this case, the hinges are permanent and have a central role in holding the operational boat together. In the present proposal, the hinges merely facilitate land transport and assembly; they have no function whatsoever once the boat is on water.

For travelling by road (vide infra), the hulls will be lifted up and secured together above the bridge-section. Prior to launching the boat, the hulls will be lowered into their working position and secured as previously described. Preferably, pintle-type hinges, as used on the rudders of many boats, are employed, allowing the hulls to be completely detached when required by a small longitudinal movement of each hull. Normally, this movement will be prevented by a removable cross-pin.

When conventional boats are launched off a slip, they are normally launched direct from their road trailer—the latter is often equipped with guides and rollers to allow the boat to be slid on and off easily. Although this is convenient in the short term, it has disastrous consequences for the road trailer itself—even when protected as far as possible, the brakes, wheel bearings etc., are rapidly corroded by the sea-water.

Preferably, the boat has a set of "FS" (Fine Sand) wheels.

These are two or more broad, one-piece plastic wheels running on a common shaft mounted on a light, collapsible framework. The framework clips on the bridge-section, and supports it at such a height that the ground clearance of the hulls, in their working position, is about 70 mm. The boat can therefore be made ready on the FS wheels, and launched off them without exposing the road trailer itself to sea-water. Once in the water, the FS wheels may be detached and either carried on the boat—being collapsible, they take up little space—or left on shore. When returning to shore, the FS wheels are refitted, and the boat hauled out in the normal way. As an alternative to being clipped on the bridge section, the FS wheels may be hinged underneath the bridge section, and be folded up against the latter when not in use.

If it is necessary to completely detach the hulls from the bridge-section, the latter, with the FS wheels, forms an engine barrow. The FS wheels are fixed roughly at the point of balance of the bridge-section with the engine mounted in its working position the stern, so that the engine, by far the heaviest single item, is easily transported. The Bachley Patent also provides his boat with wheels, but in that case, the wheels are permanently attached and project upwards from the deck of the assembled boat. The FS wheels described herein are different in principle in that they are located beneath the assembled boat and are removed entirely once the boat is afloat.

The road trailer for a conventional boat is a more or less rigid cradle, sometimes equipped with rollers, winches, etc. mounted on wheels. The not inconsiderable weight of trailers of this type is a considerable disadvantage:—it is illegal (in the U.K.) for the weight of the trailer plus load to exceed the weight of the towing vehicle, so a heavy trailer may force a boat owner to use a heavier towing vehicle than is strictly necessary for the boat itself.

For travelling by road hinged hulls will have been folded over the top of the bridge-section—otherwise, the boat is too wide to be allowed on public roads. However, if the bridge-section is, as preferred, a rigid structure, there is no need to provide separate cradle, as for a conventional boat—the "trailer", in accordance with is a skeletal framework with two pairs of road wheels, and means for fixing down the bridge-section.

In practice, the bridge-section will probably be carried on any FS wheels, and these in their turn will be secured to the road trailer.

SUMMARY OF THE INVENTION

Although suitable for various uses, the boat in accordance with the invention was initially designed to be used by SCUBA divers, for whom it immediately offers a wide deck area, which makes it easy to take gear on and off, and low freeboard, which greatly facilitates getting back on board from the water. However, the divers will also need seats for the run out to the dive-site and back, and some means of preventing divers or crew falling overboard involuntarily.

It is preferred therefore to provide a series of vertical sockets moulded into the outer gunwale of each fibre-glass hull.

These sockets may for instance take tubular steel stanchions, with, for example, their tops joined by light cord threaded through e.g. rubber, fittings at the top and preferably secured to the deck at bow and stern. Instead of using cord, it is possible to employ wire or even boards between the stanchions. Preferably, two inflatable tubes, roughly 500 mm diameter, made of stout plastics lie just inboard of the two rows of stanchions and are secured to the latter with light ties or rings around the stanchions. These tubes preferably extend virtually the full length of the hulls, and form seats for two rows of passengers, who sit facing each other, with their backs supported by the cord between the stanchions. On arrival at the dive site, one or both of these tubes may be tied to a length of rope and thrown overboard to act as a safety float, thereby providing extra free deck-space. One or both sets of stanchions can be removed, allowing divers to enter or leave the water down the full length of the hull.

The sockets for the stanchions can be put to other uses if required e.g., they could support an awning, and "A" frame for radio aerials and navigation lights, or a tent or dodger.

Divers frequently need to raise heavy objects from the sea bed. For this purpose the boat in accordance with the invention can be fitted with a winch on the bridge-section, with the lifting going down through a hole in this deck. This would allow heavy objects to be winched up to the bottom of the boat; they could then be taken to suitable shallow water for final recovery. Loads of up to 2036 kg=two tons (i.e. a large motor-car) could be easily handled.

The various aspects of the invention will now be described in greater detail, by way of example, with reference to the accompanying drawings, in which.

Figure 1:
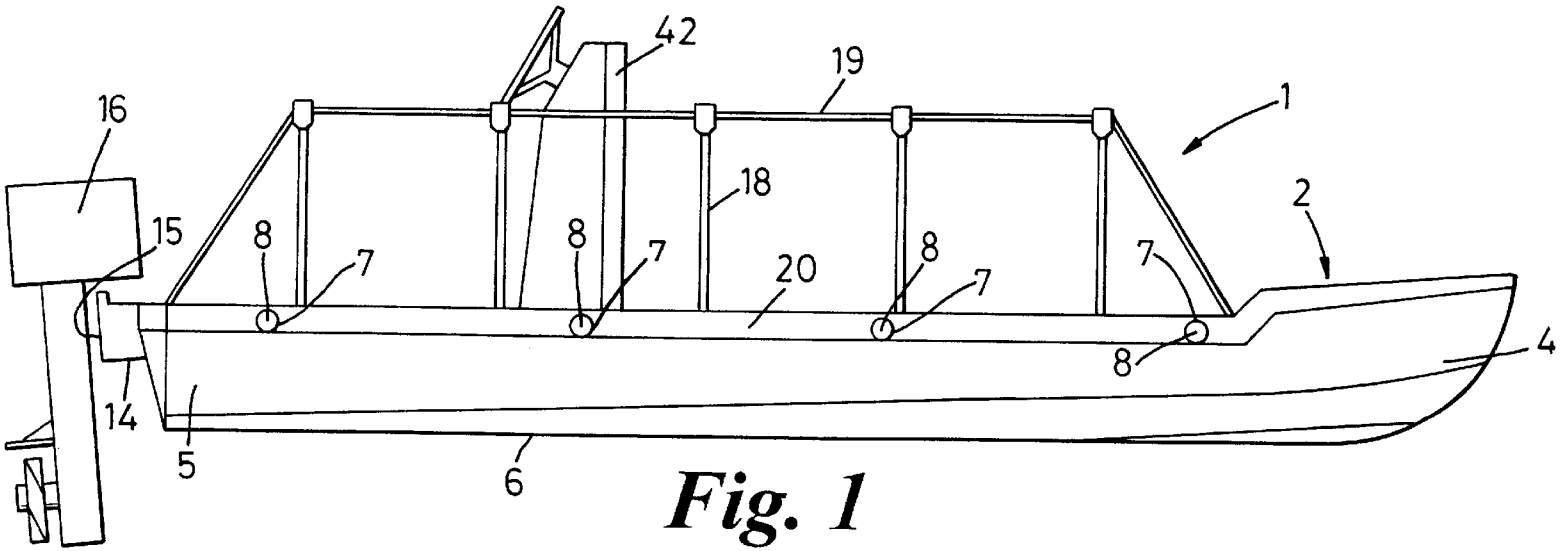
FIG. 1 is a side elevation of a boat.
Figure 2:
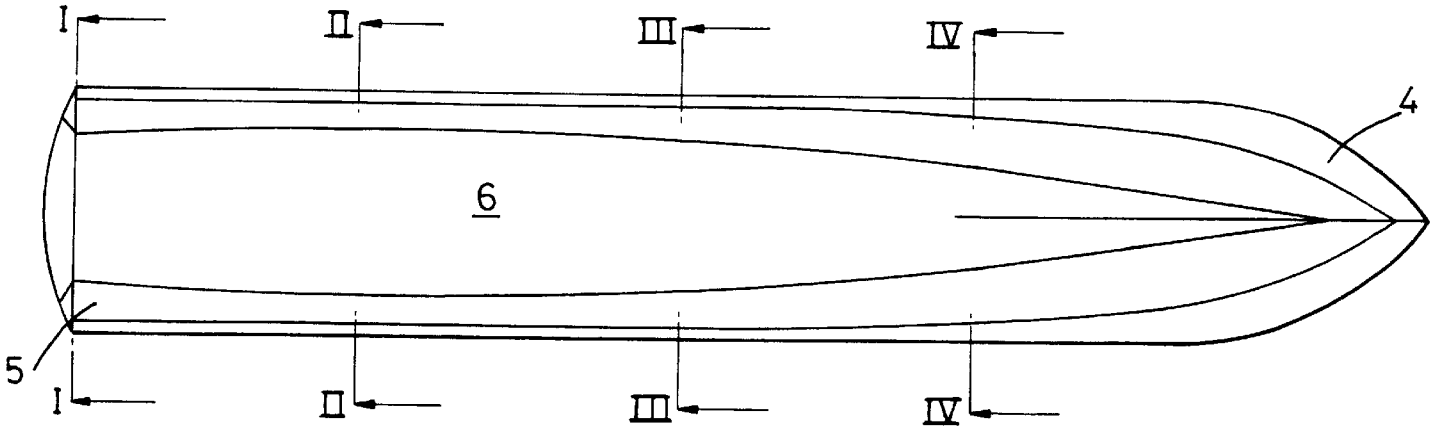
FIG. 2 is an underneath plan view of one hull.
Figure 3A:
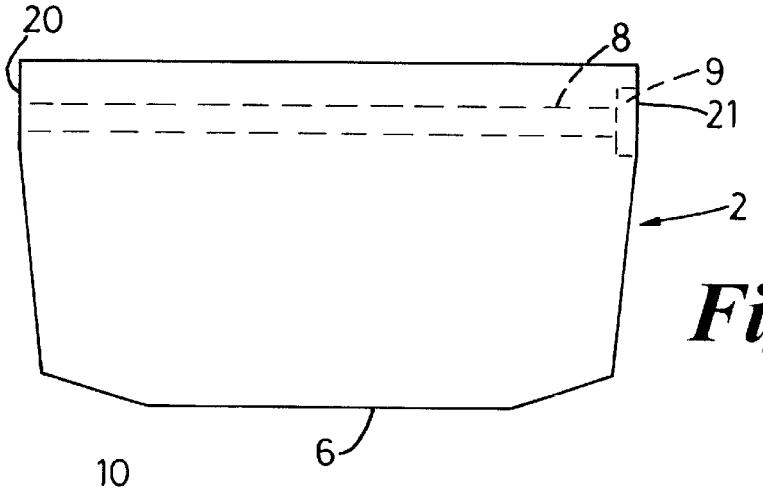
FIGS. 3A, 3B, 3C and 3D are sections through the hull respectively on lines I—I, II—II, III—III and IV—IV of FIG. 2.
Figure 3B:
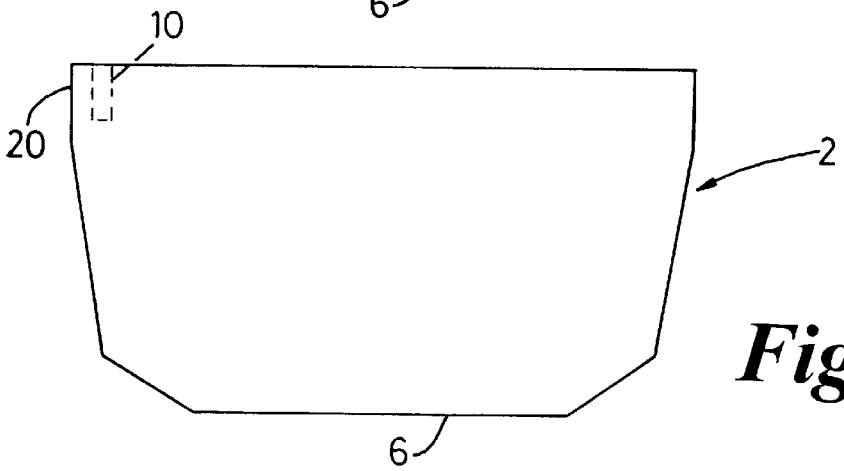
Figure 3C:
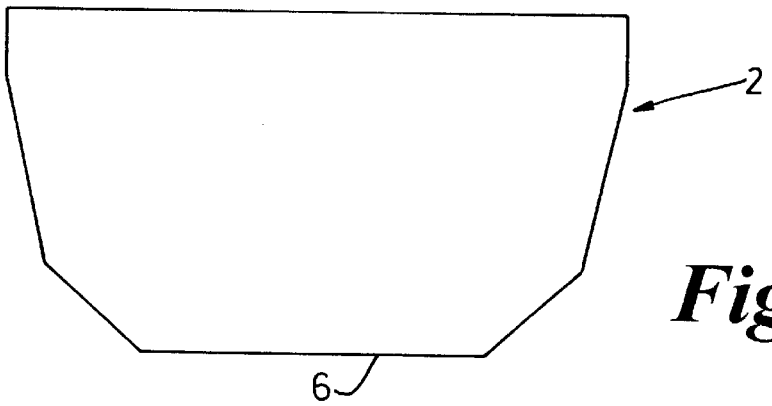
Figure 3D:
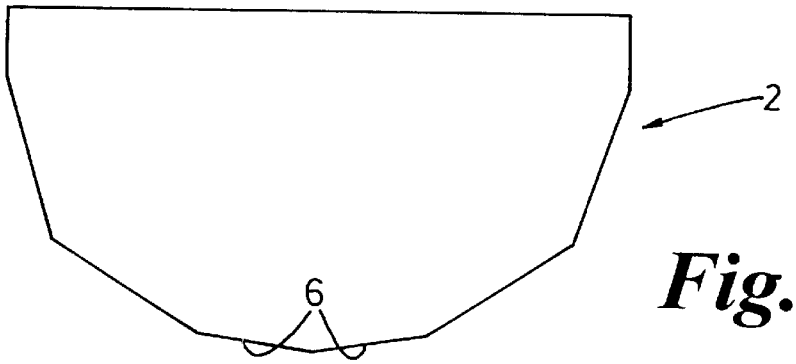
Figure 4:
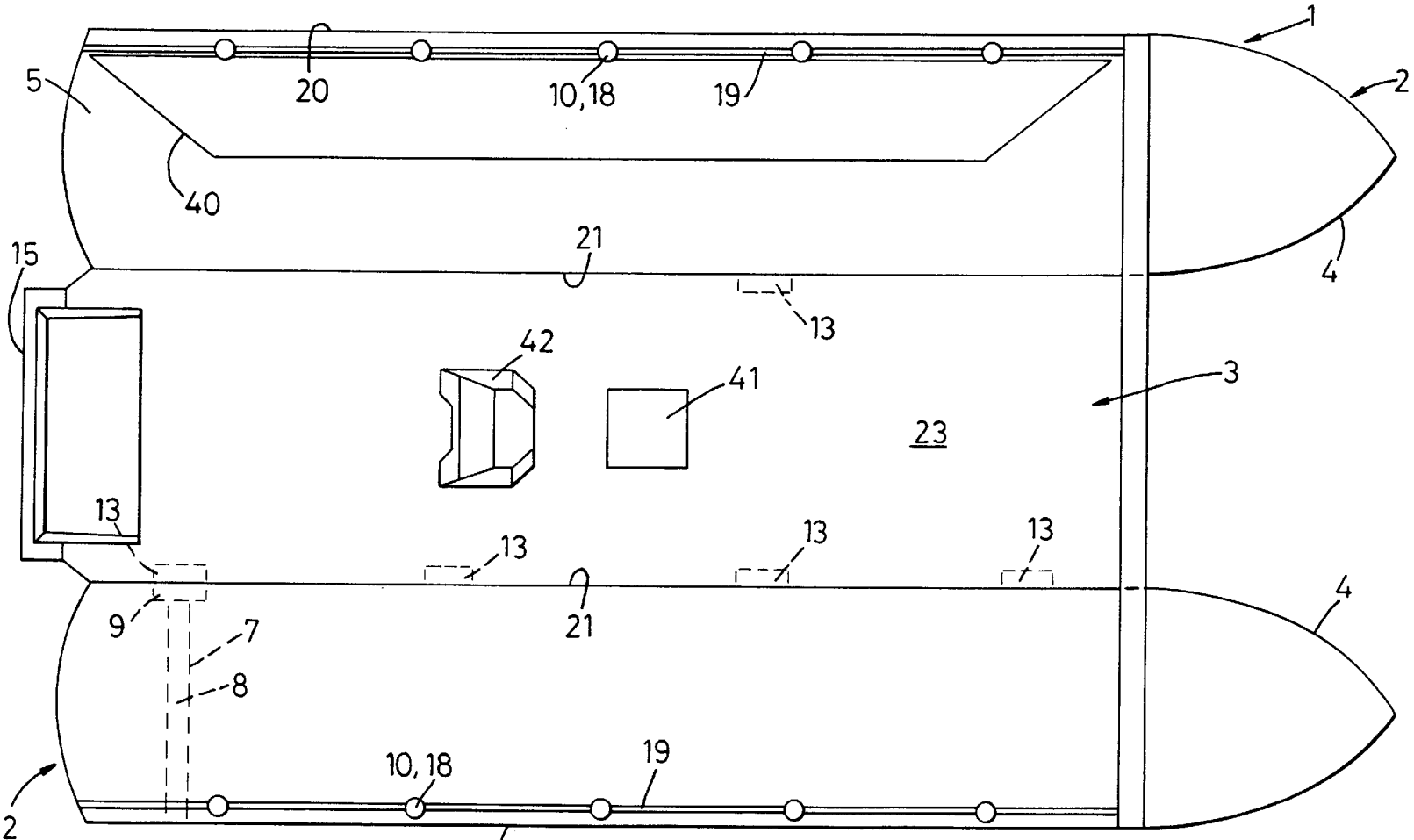
FIG. 4 is a top plan of the boat of the preceding Figures.

In the drawings, a twin-hulled boat 1 comprises two parallel, relatively narrow and relatively long hulls 2 interconnected by a central bridge section 3. Each hull 2 has a bow section 4 and a stern section 5 and a flat bottom 6 which extends over the majority of the length of each hull 2 from the stern section 5 to terminate in the vicinity of the bow section 4, while the beam ratio of hull/bridge section/hull is 30%/40%/30% approximately.

Each hull 2 is of synthetic plastics material, being laid up using woven glass cloth and during construction four spaced-apart, transverse steel tubes 7 are incorporated in each hull 2, each tube 7 housing a screw mechanism 8 operable from the outer gunwale 20 the hull 2 and terminating at the inner gunwale 21 of each hull 2 and hence adjacent the central bridge section 3, in a heavy duty steel plate 9. Also during construction five spaced-apart upright sockets 10 are incorporated in each hull 2 along the outer gunwale 20 of each hull 2.

Figure 5:
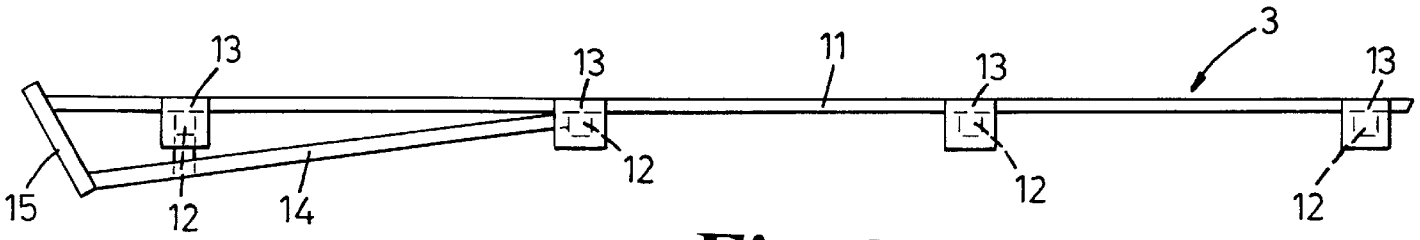
FIGS. 5 and 6 are respectively a side elevation and a plan view of the central bridge section of the boat of the preceding Figures.
Figure 6:
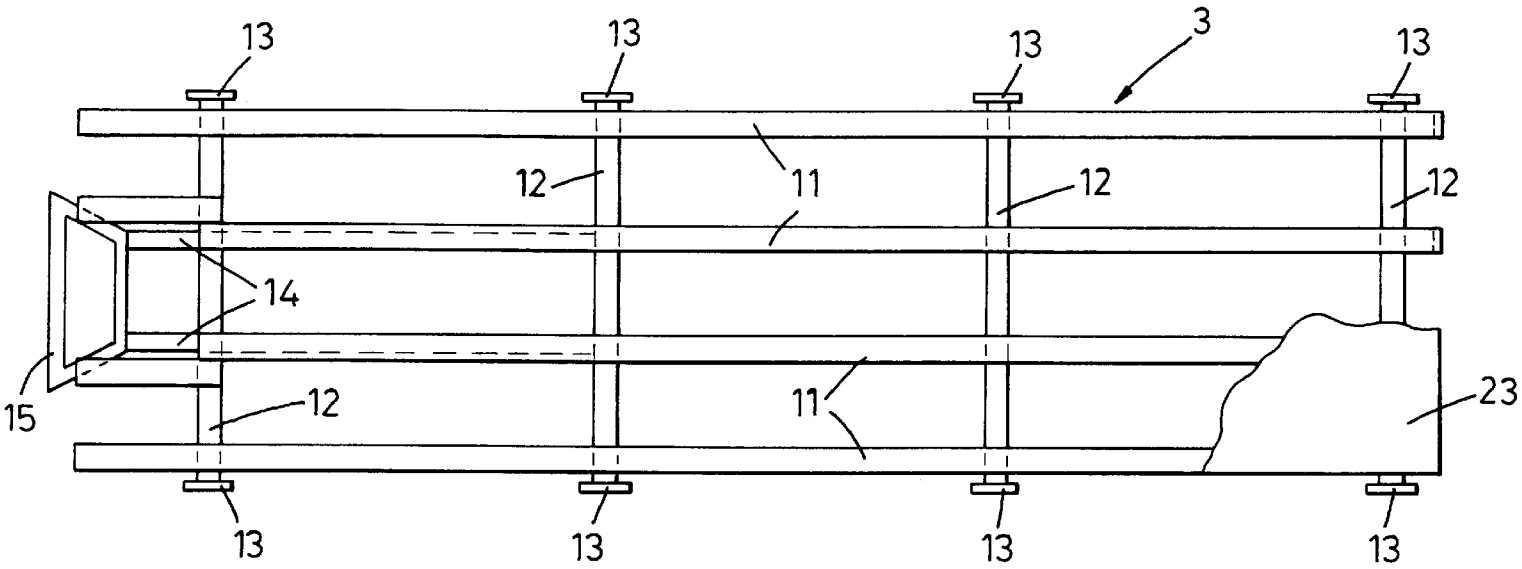

As seen in FIGS. 5 and 6, the central bridge section 3 is constituted by a metallic frame 22 comprising four longitudinal beams 11 located in spaced-apart, parallel relationship, and four transverse beams 12 secured by welding to the undersides of the four beams 11. For clarity, decking 23 (e.g. marine plywood) covering the metallic frame 22 has been indicated only partially in FIG. 6. Each transverse beam 12 terminates in a plate 13 adapted, when the two hulls 2 are presented to opposite sides of the central bridge section 3, to engage frictionally a respective plate 9 so that, when the screw mechanisms 8 are activated the four plates at each side of the central bridge section 3 are brought into tight frictional engagement with the four plates of each hull 2. FIGS. 5 and 6 also illustrate the provision of rearwardly extending support beams 14 terminating in a transom 15 to receive an outboard motor 16, as indicated in FIG. 1.

Figure 7:
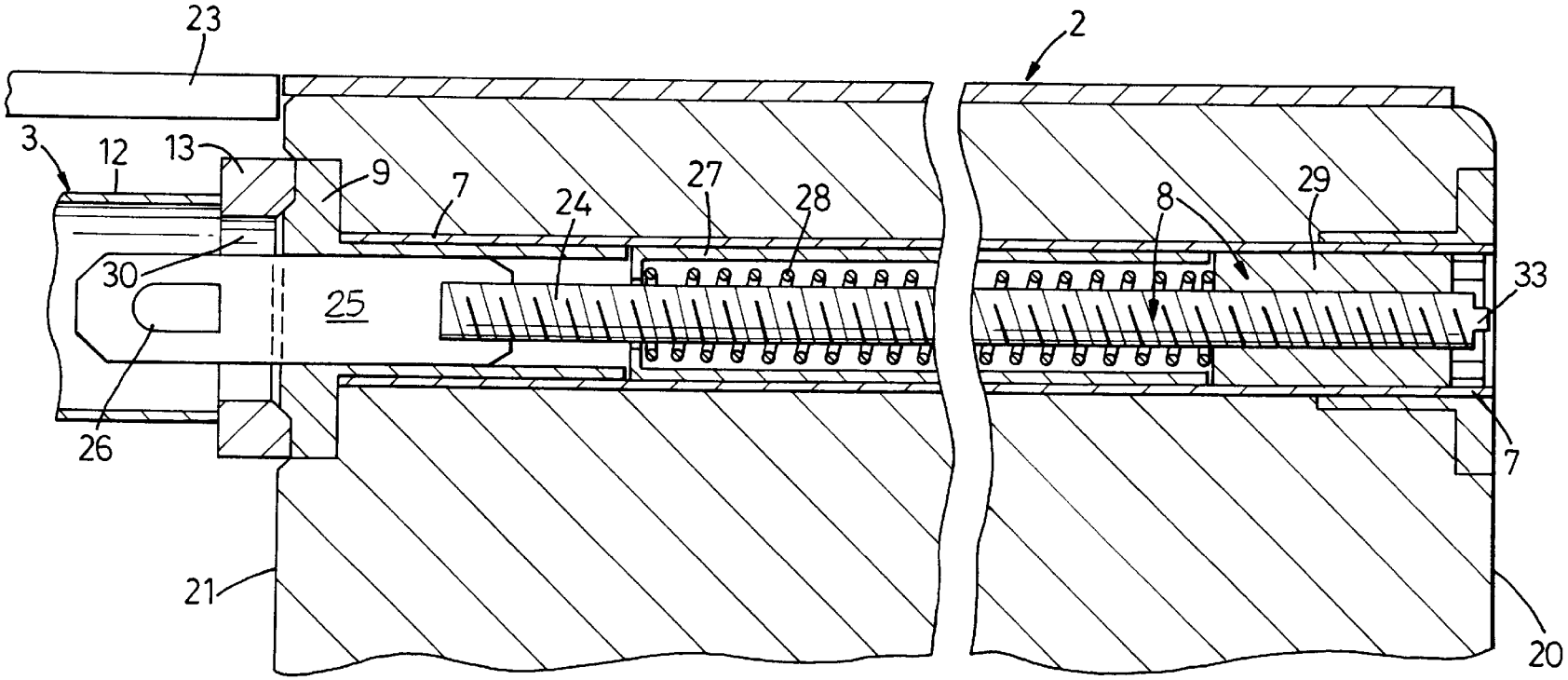
FIG. 7 is a sectional view detailing an attachment point of a hull to the central bridge section.

As detailed in FIG. 7, each tube 7 houses a threaded stud 24 having at one end a head 25 with an arrow head type connector 26, the stud 24 passing through a pressure sleeve 27 housing a fail-safe spring 28, and through a castellated nut 29 engageable by a suitable rotational tool to bring the plates 9 and 13 into tight frictional engagement under several tons loading.

Figure 8:
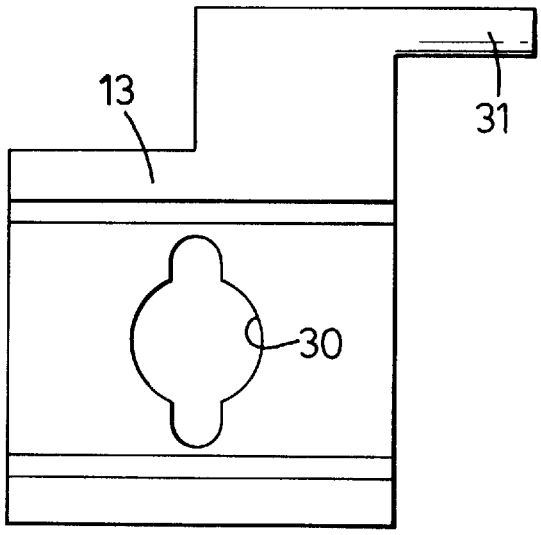
FIGS. 8 and 9 are respectively a front elevation and an end elevation of a plate of the central bridge section.
Figure 9:
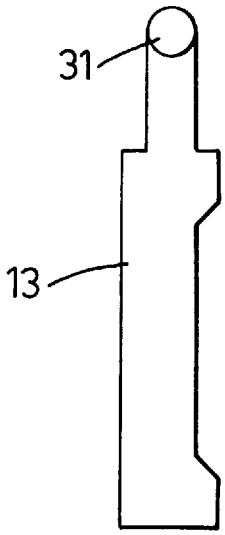

FIGS. 8 and 9 detail a simple hinge arrangement in that each plate 13 additionally constitutes a male hinge part by being provided with an integral, longitudinally extending pintle 31 engageable in a receiving hole 32 in the plates 9, which plates thereby constitute female hinge parts, while the connector 26 of the stud 24 passes through an elongated hole 30 in each plate 13 and is rotated through 90° by a tool engaging a diametrical rib 33 at the other end of the stud 24.

Figure 12:
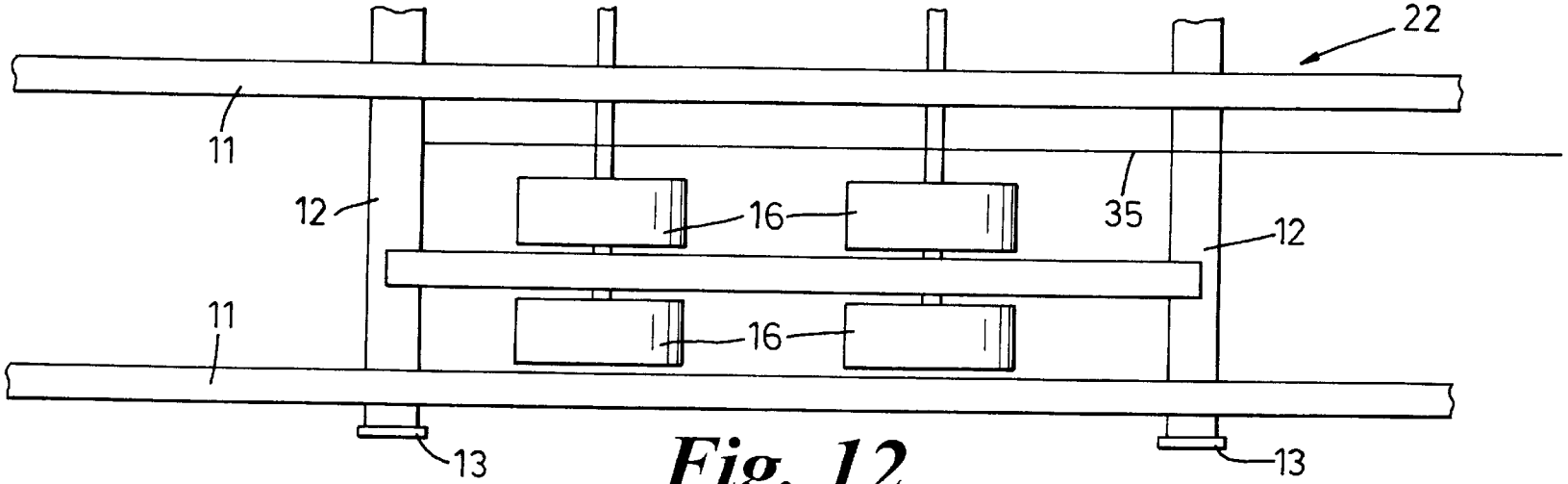
FIGS. 12 and 13 are respectively a plan view and a side elevation of a portion of the central bridge section showing FS wheels.
Figure 13:
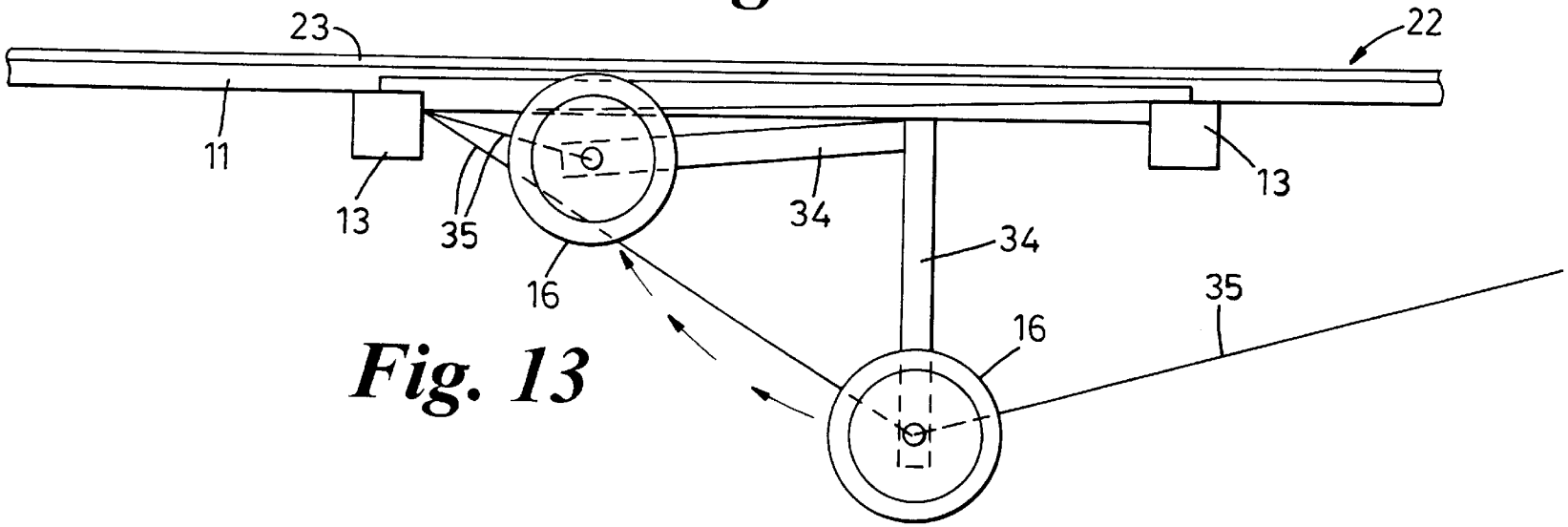

In FIGS. 12 and 13 are illustrated pairs of FS wheels 17 located between the two mid-transverse beams 12. The wheels 17 are connected to the frame 22 by hingeable struts 34, so that the wheels 17 are displaceable between the lower, ground engaging, operable position, in which they are retained by a locking line 35, and an upper, non-operative position, in which they are folded beneath the frame 22 and again retained by the line 35.

Figure 15:
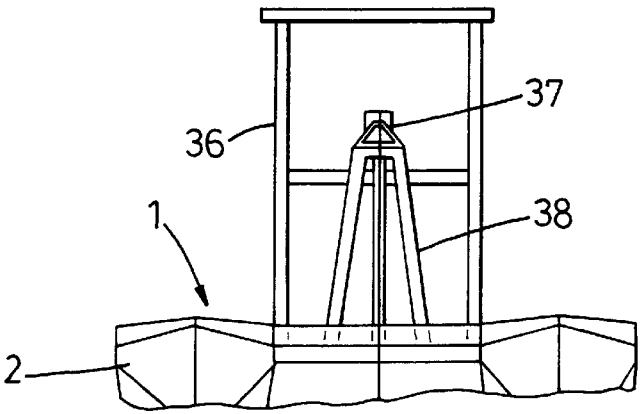
FIGS. 14 and 15 are respectively a side elevation and a front elevation of one winch configuration.
Figure 14:
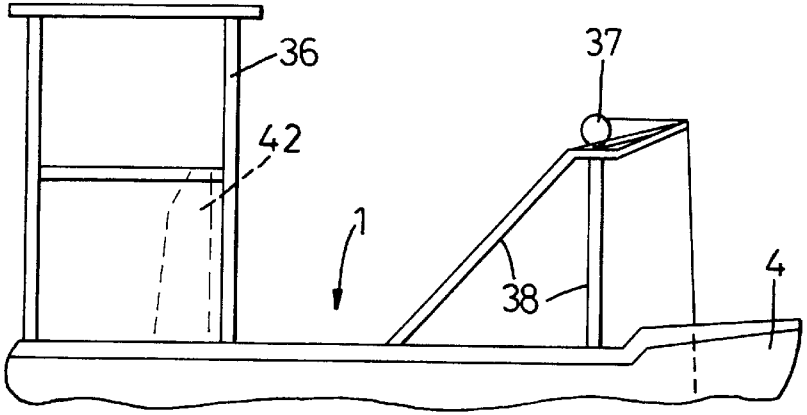

FIGS. 14 and 15 indicate that the boat 1 may be provided with a wheel house 36 and a winch 37 (e.g. 254 kg=¼ ton) mounted on a 1 m (40") high tripod 38, with 12 volt batteries to power the winch being housed within a console 42, with the winch being operable in the gap between the bow sections 4.

Figure 17:
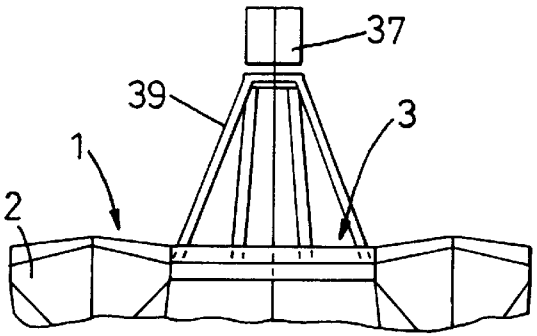
FIGS. 16 and 17 are respectively a side elevation and a front elevation of a second winch configuration.
Figure 16:
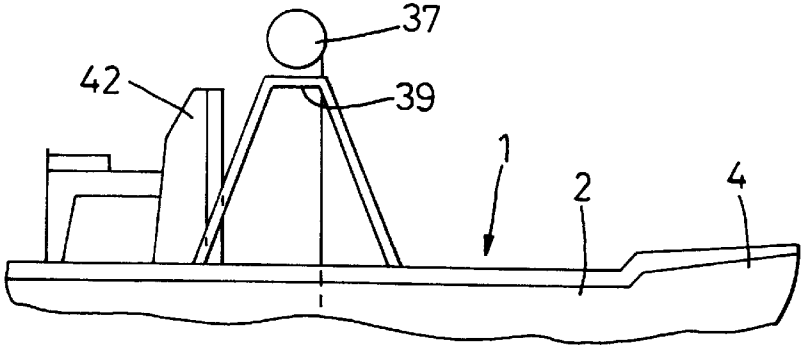

FIGS. 16 and 17 indicate a boat 1 provided with a winch 37 (e.g. 1018 kg=1 ton) on a 1 m (40") high table 39, again being battery powered, but operable through a hole normally closed by a cover 41 in the decking 23.

Figure 10:
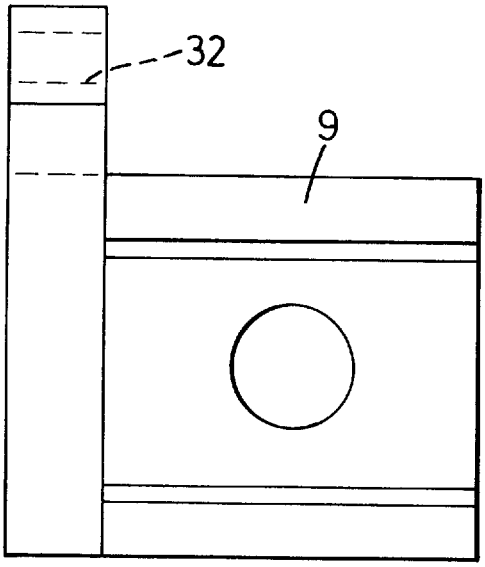
FIGS. 10 and 11 are respectively a front elevation and an end elevation of a plate of a hull.
Figure 11:
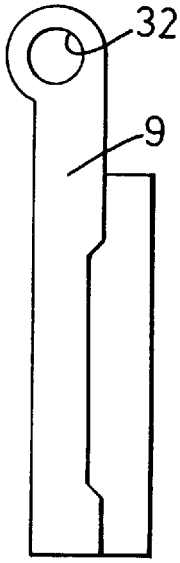

From the hinge mechanism detailed in FIGS. 8 to 10, it is apparent that, for transport, upon release of the screw mechanisms 9, the two hulls 2 may be folded, and inverted so as to seat on the central bridge section 3 for transport to or from the water, by fitting to the bridge section 3 the FS wheels 17, or alternatively for road transport by fitting the bridge section 3 with road wheels, thereby obviating the need for a road trailer.

As illustrated in FIG. 1, each socket 10 is adapted to be fitted with a stanchion 18 through which a tension plastic rope 19 may be fitted, to serve as a grab line and/or a back rest, for persons, e.g. divers, seated on an inflatable seat 40 for transport to and from a dive site.

What we claim is:

1. A twin-hulled boat (1) constructed from three individual parts being two parallel, relatively narrow and relatively long hulls (2) each individually connected, at releasable joints (13,9), to a central, rigid bridge section (3), and separable, upon release of the joints (13,9) into three individual parts, with each hull (2) having a bow section (4) and a stern section (5), and with the hulls (2) having virtually flat bottoms (6) apart from the bow sections (4), wherein said releasable joints are two-part metal-to-metal friction joints with one-part (13) of each of said joints located within, and a lateral side of, said central bridge section (3), and the other part (9) of each of said joints located at inner gunwales (21) of each hull (2), with, for each of said joints, individual independent, screw incorporating means (26),(24),(27),(29), (33) operable on both parts (13,9) of each joint to urge the parts (13,9) of each said joint together into tight frictional engagement with one another.

2. A twin-hulled boat as claimed in claim 1, wherein the beam ratio of hull/bridge section/hull is 30%/40%/30% approximately.

3. A twin-hulled boat (1), as claimed in claim 1, wherein the hulls (2) are flat topped, and the bridge section (3) is flush with the hull tops, whereby a single flat deck area is available over the full beam of the boat.

4. A twin-hulled boat as claimed in claim 1, wherein the flat bottom (6) extends from the base of the stem section (5) forwards for approximately 58% of the overall length of the boat (1).

5. A twin-hulled boat as claimed in claim 4, wherein, after approximately 58% of the overall length of the boat (1), the bottom (6) is formed into a "V" of approximately 143° for approximately 23% of the overall length of the boat (1) to meet the bow section (4).

6. A twin-hulled boat (1) as claimed in claim 1, wherein said releasable joints are operable from the outer gunwales (20) of each hull (2).

7. A twin-hulled boat (1) in claim 1, wherein the hulls (2) are made of fibre-glass and filled with plastic foam.

8. A twin-hulled boat as claimed in claim 7, wherein the fibre-glass is woven glass cloth.

9. A twin-hulled boat (1) as claimed in claim 7, wherein a plurality of transversely extending attachment means (7) are incorporated into each hull (2), being spaced-apart along the hull (2) and terminating, at an inner gunwale (21), in a metal plate (9) forming half of one of said releasable joints.

10. A twin-hulled boat (1) as claimed in claim 9, wherein the bridge section (3) is provided at each lateral side with a corresponding plurality of metal plates (13) each forming the other half of one of said releasable joints to mate with a metal plate (9) of an adjacent hull (2).

11. A twin-hulled boat (1) as claimed in claim 10, wherein said plurality is four.

12. A twin-hulled boat (1) as claimed in claim 9, wherein each attachment means (7) comprises a steel tube housing a screw mechanism (8) operable from an outer gunwale (20) of the hull (2).

13. A twin-hulled boat (1) as claimed in claim 1, wherein the bridge section (3) is constituted by a metallic frame (22).

14. A twin-hulled boat (1) as claimed in claim 13, wherein the metallic frame (22) comprises a plurality of longitudinally extending, mutually spaced-apart, parallel beams (11), interconnected by a plurality of transversely extending, mutually spaced-apart, parallel beams (12).

15. A twin-hulled boat (1) as claimed in claim 14, wherein the beams (11, 12) are of hollow square section material.

16. A twin-hulled boat (1) as claimed in claim 7, wherein a series of vertical sockets (10) are incorporated, by moulding, into and along the outer gunwale (20) of each hull (2).

17. A twin-hulled boat (1) as claimed in claim 16, wherein each socket (10) receives a stanchion (18), tops of which are joined by a rope (19).

18. A twin-hulled boat (1) as claimed in claim 17, wherein an inflatable tube to serve as a seat (40), is provided just inboard of the row of stanchions (18).

19. A twin-hulled boat (1) as claimed in claim 1, wherein a set of wheels (17) is hinged to the bridge section (3) and is folded up against the bridge section (3) when not in use.

20. A twin-hulled boat (1) as claimed in claim 1, wherein a winch (37) or other modular feature(s) is fitted on the bridge section (3).

21. A twin-hulled boat (1) constructed from three individual parts being two parallel, relatively narrow and relatively long hulls (2) each individually connected, at releasable joints (13,9), to a central, rigid bridge section (3), and separable, upon release of the joints (13,9) into three individual parts, with each hull (2) having a bow section (4) and a stern section (5), and with the hulls (2) having virtually flat bottoms (6) apart from the bow sections (4), wherein said releasable joints are two-part metal-to-metal friction joints with one-part ( 13) of each of said joins located within, and at a lateral side of, said central bridge section (3), and the other part (9) of each said joints located at inner gunwales (21) of each hull (2), with, for each of said joints, individual independent, screw incorporating—means (26),(24),(27), (29), (33) operable on both parts (13,9) of each joint to urge the parts (13,9) of each said joint together into tight frictional engagement with one another, where said means to urge said parts (13,9) of each individual joint into tight frictional engagement with one another, comprises a threaded stud (24) having at one end a head (25) with an arrow head type connector (26) adapted to pass through an elongated hole (30) in said part (13) and then to be rotated through 90° before tightening of a nut (29) threaded on to an end of said stud (24) distal from said head (25).

22. A twin-hulled boat as claimed in claim 21, wherein said nut (29) engages a pressure sleeve (27) which in turn engages said joint part (9).

23. A twin-hulled boat (1) constructed from three individual parts being two parallel, relatively narrow and relatively long hulls (2) each individually connected, at releasable joints (13,9), to a central, rigid bridge section (3), and separable, upon release of the joints (13,9) into three individual parts, with each hull (2) having a bow section (4) and a stern section (5), and with the hulls (2) having virtually flat bottoms (6) apart from the bow sections (4), wherein said releasable joints are two-part metal-to-metal friction joints with one-part (13) of each of said joints located within, and at a lateral side of, said central bridge section (3), and the other part (9) of each of said joints located at inner gunwales (21) of each hull (2), with, for each of said joints, individual independent, screw incorporating means (26),(24),(27),(29), (33) operable on both parts (13,9) of each said joint into tight frictional engagement, wherein the hulls (2) are of fibreglass, with a plurality of transverse steel tubes (7) incorporated in each hull (2) and terminating at inner gunwale (21) in a steel plate (9) constituting one joint half.

24. A twin-hulled boat (1) as claimed in claim 23, wherein a screw mechanism (8) is housed in each of said tubes (7).

25. A twin-hulled boat as claimed in claim 24, wherein each of said screw mechanisms (8) is operable from outer gunwale (20) of each hull (2).

* * * * *